US007341773B1

(12) United States Patent
Schulte

(10) Patent No.: US 7,341,773 B1
(45) Date of Patent: Mar. 11, 2008

(54) FLOOR CARPET INSTALLING SYSTEM

(75) Inventor: Axel Schulte, Holzgerlingen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/601,280

(22) PCT Filed: Nov. 2, 1998

(86) PCT No.: PCT/EP98/06930

§ 371 (c)(1),
(2), (4) Date: Jul. 21, 2000

(87) PCT Pub. No.: WO00/16671

PCT Pub. Date: Mar. 30, 2000

(30) Foreign Application Priority Data

Sep. 22, 1998 (WO) ..... PCT/EP98/06020

(51) Int. Cl.
*B32B 33/00* (2006.01)

(52) U.S. Cl. ..... 428/95; 428/96; 428/99; 428/100

(58) Field of Classification Search ..... 428/95, 428/96, 99, 100
See application file for complete search history.

(56) References Cited

U.S. PATENT DOCUMENTS 4,822,658 A * 4/1989 Pacione ..... 428/100
5,380,574 A * 1/1995 Katoh et al. ..... 428/92
5,382,462 A * 1/1995 Pacione ..... 428/100
5,658,430 A * 8/1997 Drake et al. ..... 156/71
5,753,336 A 5/1998 Stull
5,902,427 A * 5/1999 Zinke et al. ..... 156/290
6,217,974 B1 * 4/2001 Pacione ..... 428/95
6,287,665 B1 * 9/2001 Hammer ..... 24/452
6,298,624 B1 * 10/2001 Pacione ..... 52/511
6,699,560 B1 * 3/2004 Schulte ..... 428/95

FOREIGN PATENT DOCUMENTS

DE 19532685 3/1997
DE 19646318 5/1998
DE 19828856 10/1999
EP 0321978 3/1994
EP 988808 A1 * 3/2000
FR 2282999 3/1976
WO WO 9641716 A1 * 12/1996

* cited by examiner

*Primary Examiner*—Cheryl Juska
(74) *Attorney, Agent, or Firm*—Roylance, Abrams, Berdo & Goodman, L.L.P.

(57) ABSTRACT

A system for installing floor carpets, includes a carpet nap side having forming the useful surface and an anchor that can be fixed to the floor surface. The anchor has protuberant interlocking elements that interlock with the backside of the carpet opposite the nap side. The backside of the carpet is formed by a material having no loops. The anchor includes a loopless material glued to the floor surface. A micro-adhesive closure element having interlocking elements on both sides in the form of fingers with thickenings on the ends, interlock with the loopless backside of the carpet and with the loopless material on the floor surface.

17 Claims, 2 Drawing Sheets

FLOOR CARPET INSTALLING SYSTEM

FIELD OF THE INVENTION

The present invention relates to a floor carpet installation system with a carpet forming the usable surface with its nap side, a loopless material glued together with the floor surface, as well as an anchoring means which has protruding interlocking elements on both sides. The interlocking elements interlock with the backside of the carpet formed of a loopless material opposite the nap side on one side, and interlock with the loopless material on the floor surface on its opposite side.

BACKGROUND OF THE INVENTION

A floor carpet installation system is disclosed in FR 2 282 999 A. In this conventional system, strips are provided and aligned on the carpet edges as anchoring means. Both sides of the strips have protruding interlocking elements in the form of bristles inclined relative to the carpet plane. These bristles are inclined on one side and on the other side in turn in opposite directions from one another. This opposing inclination of the bristles, with the interlocking with the loopless backside of the carpet and with the loopless material of the carpet fastened to the floor, is intended to prevent sliding along the carpet plane. However, this type of anchoring does not guarantee a sufficiently secure connection. Thus, it can lead to the formation of buckling and displacement during use. Especially under greater stresses, for example by sliding of heavy pieces of furniture, the danger of great damage can exist.

SUMMARY OF THE INVENTION

Objects of the present invention are to provide a floor carpet installation system which is characterized by comparably improved properties of use.

With the floor carpet installation system, these objects are attained by the present invention in that a micro-adhesive closing element is provided as the anchoring means. The anchoring means has interlocking elements configured in the form of fingers with thicknesses at their ends. The interlocking elements include different shapes and/or dimensions and/or different reciprocal distances from one another on both sides of the adhesive closing element.

The anchoring provided according to the present invention by a double-sided micro-adhesive closing element having interlocking elements arranged on both sides in the form of fingers with thicknesses at their ends, interlocks on each side in turn with a loopless material and leads to several advantages. On the one hand, this type of interlocking yields a particularly secure connection against the relative movements along the carpet plane. On the other hand, since in this arrangement the adhesive closing element is not adhered directly with the floor surface, but rather is interlocked with a likewise loopless material fastened to the floor surface, the present invention avoids the danger that shrinkage or displacements occurring following the hardening or aging process of the finish of the floor could lead to a detachment of the anchoring.

The loopless material on the floor surface forms a compensation layer having a certain flexibility to compensate for the shrinkage or displacements. In addition, this layer fixed to the floor surface also causes footstep-sound-absorption.

Another advantage results from the selection of the dimensions and the shape and/or selection of the number of interlocking elements per surface unit. The degree of interlocking effect on both sides of the adhesive closing element can be selected in a suitable manner by such selection. Thus, for example, the adhesive effect on the bottom of the adhesive closing element turned toward the floor finish can be selected to be more powerful than the adhesive effect against the loopless material on the backside of the carpet. With lifting of the carpet, which with interlocking with loopless material of the carpet backside is possible by overcoming the adhesive force therebetween, the adhesive closing element in this case remains interlocked with the floor-side loopless material, so that following lifting of the carpet a renewed installation is possible without further processes.

A micro-adhesive closing element configured similar to that element is disclosed in DE 196 46 318 A1 and is suitable for the installation system according to the present invention. However, that micro-adhesive closing element nonetheless differs from the element of the present invention in that the front side and the backside of the carrier of the present invention only are constructed with corresponding interlocking elements.

According to the make-up of the carpet to be installed, in other words according to the structure of the backside, a micro-adhesive closing with a thickness of the carrier of the interlocking elements of 0.1 to 0.5 mm and with 20 to 600 interlocking elements per $cm^2$ can be used on each side.

The thicknesses of the fingers of the interlocking elements can have the shape of mushroom heads or plate-shaped heads. The heads are preferably provided with concave depressions on the top sides. One method for the especially simple manufacture of micro-adhesive closing elements with such interlocking elements in a one-side arrangement is suggested in the German patent application 198 28 856.5.

With use of interlocking elements having depressions on the tops of the heads, the depressions of the heads can be provided with an adhesive providing an additional connection with the backside of the carpet and/or the floor-side material. The adhesive can be applied, for example, by scraping on.

Textile materials in the form of felts or fleeces, or else loose leno weave or flat knit, as well as non-woven textiles can be provided as backside of the carpet and as the loopless material glued with the floor.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
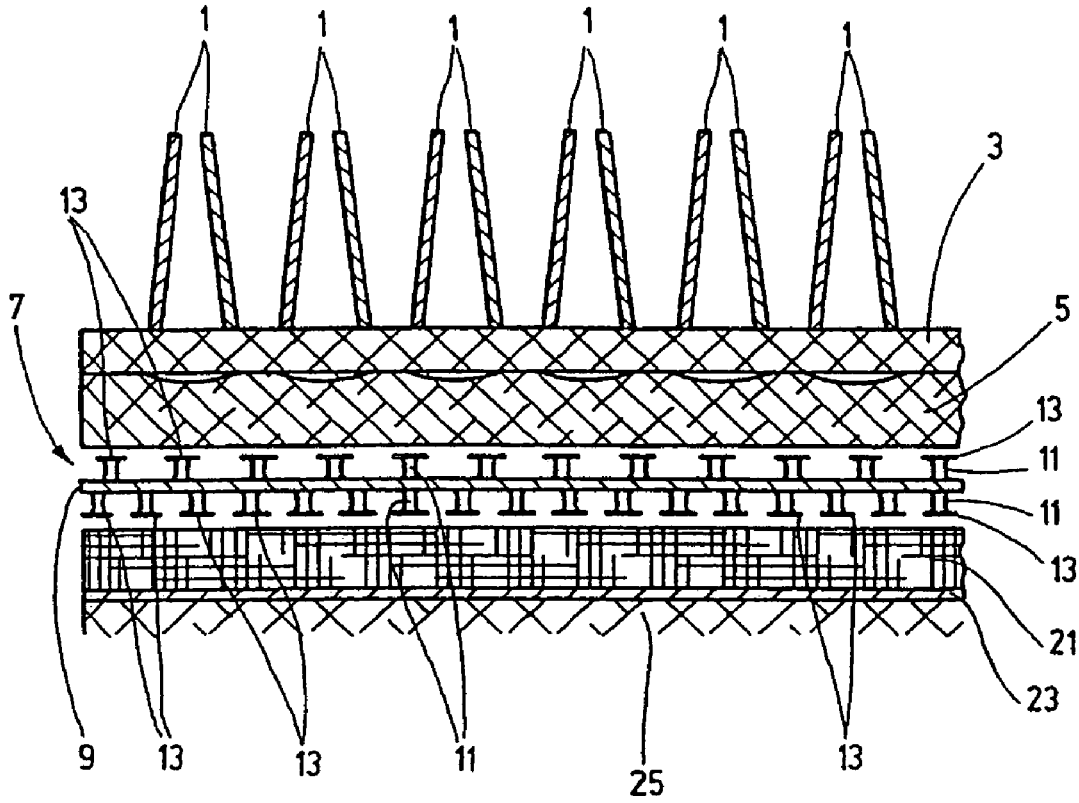
FIG. 1 is a diagrammatically simplified, partial side elevational view in section of the components of the floor carpet installation system according to the present invention.

FIG. 1 is an enlarged, diagrammatic simplified representation in cross section of a floor carpet with nap elements 1 of the traditional type. Nap elements 1 extend upward from a connection layer 3, and form the nap side of the carpet serving as its usable surface. The backside 5, opposite the nap side, is formed by a loopless material. For this purpose, materials could be used lending the carpet structure a certain rigidity, directional alignment stability and tear resistance. Therefore, felt or fleece could be used, obtaining their mechanical composition by the tufting method, and are adhered to connection layer 3 of the carpet. Also, loose leno weave or flat knit and other so-called non-woven materials are suitable for backside 5.

Figure 2:
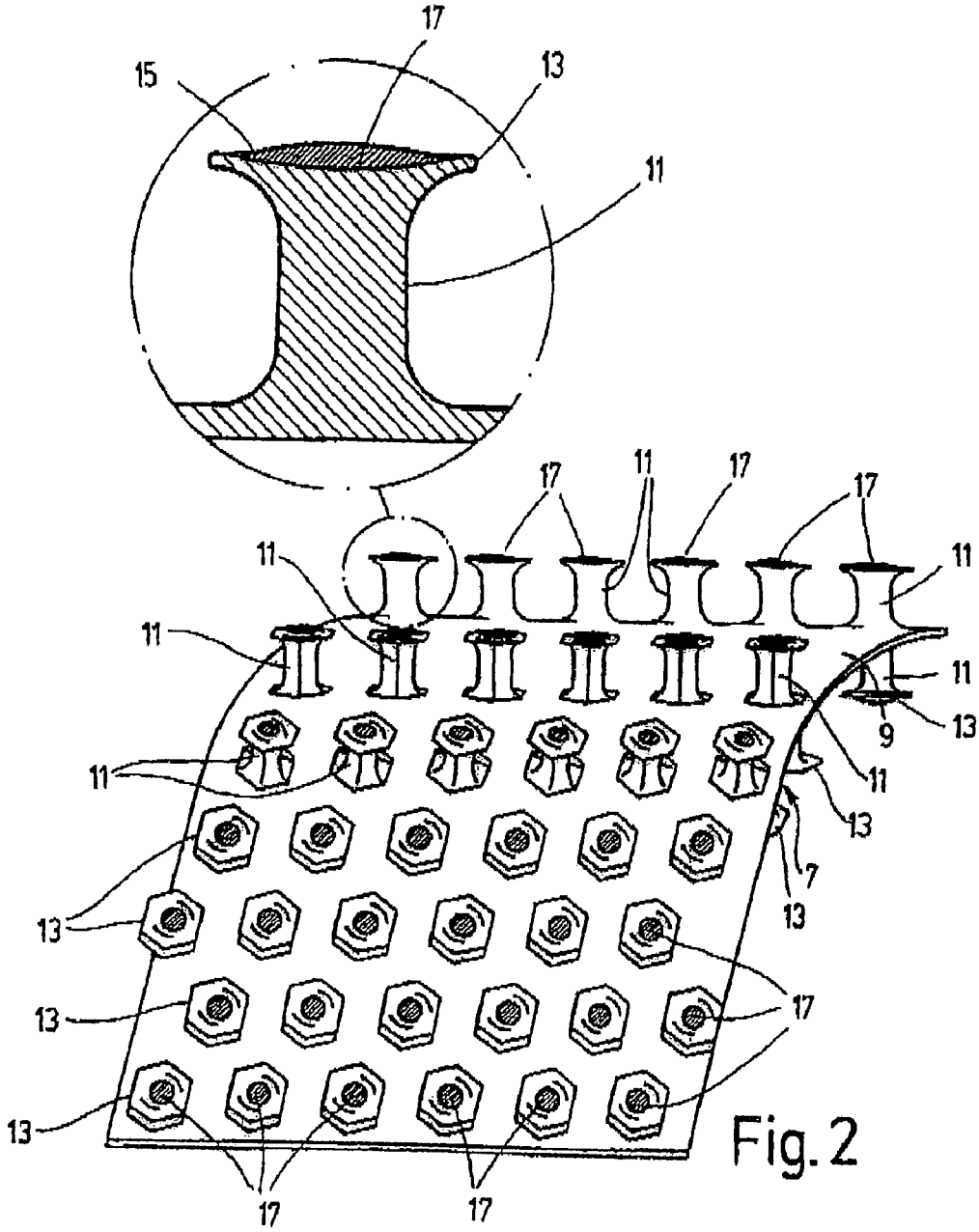
FIG. 2 is a perspective, greatly enlarged view of a double-sided micro-adhesive closing element of the floor carpet system of FIG. 1, with one individual interlocking element illustrated in an enlarged side elevational view in section.
Figure 3:
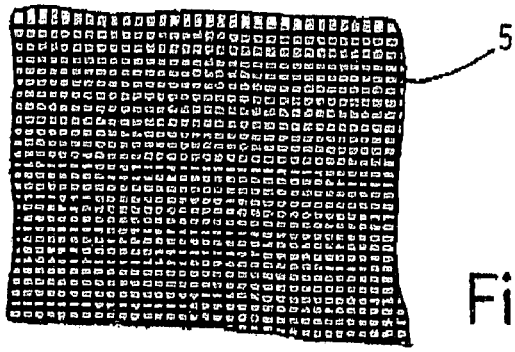
FIG. 3 is a partial plan view in substantially actual scale of a loopless backside of the carpet of FIG. 1.

FIG. 2 shows a section of a strip of a micro-adhesive closing element 7, similar to that disclosed in DE 196 46 318 A1. The thermoplastic strip (for example, polyolefines or blends of polyamides) is formed in the gap between top and bottom shaping tools, and forms a foil-like carrier 9 with fingers 11 protruding from its top and bottom, respectively. Fingers 11 protrude from the top of carrier 9, have thickened ends forming mushroom-shaped or plate-shaped heads 13, and come into interlocking engagement with the loopless material of backside 5 of carpet. The fingers directly engage the carpet backside. According to the mechanical construction and quality of the structure of backside 5 of the relevant carpet, the arrangement of fingers 11 has a packing density of approximately 20 to 600 fingers 11 per $cm^2$, with a thickness of carrier 9 of approximately 0.1 to 0.5 mm. Other packing densities and/or thicknesses of carrier 9 can of course be used according to the special circumstances. Such fingers are also on the bottom of carrier 9. Fingers 11 on the bottom of carrier 9 interlock with loopless material 21 fastened via member 23 to floor surface 25, as shown in FIG. 1.

As can be recognized, particularly from the sectional representation shown greatly enlarged in FIG. 2, the thickened heads 13 of fingers 11 are formed into mushroom- or plate-shapes with concave arcuate tops. Within the edge of each head 13, a depression 15 is formed.

With the example shown in FIG. 2, the depression 15 of head 13 is filled with an adhesive 17. This can be applied by spreading on or scraping on, in order to produce an additional connection following the interlocking engagement with backside 5 of the relevant carpet or the floor loopless material. Adhesives on acrylate base can be used as the adhesive material, for example, 2-ethyl hexyl acrylate or butyl acrylate, preferably in different selected mixture ratios, in order to vary the plasticizing, plasticity and adhesive power as desired and as required.

With wall-to-wall installation of carpets, adhesive closings 7 can be provided in the form of long strips or bands. With installation of the carpet in tile-like or flagstone-like form, shorter, strip sections adapted in a suitable manner to the individual tile parts can be provided.

While one embodiment has been chosen to illustrate the invention, it will be understood by those skilled in the art that various changes and modifications can be made therein without departing from the scope of the invention as defined in the appended claims.

What is claimed is:

1. A floor carpet installation system, comprising:

a carpet having a nap side forming a usable surface thereof and having a backside formed of a carpet loopless material opposite said nap side;

a floor loopless material fixable to a floor surface; and a micro-adhesive closing element having opposite carpet and floor surfaces, each of said surfaces having protruding interlocking elements, said elements on said carpet and floor surfaces interlocking with said carpet and floor loopless materials, respectively, said interlocking elements being configured as fingers with thicknesses at free ends thereof, said interlocking elements on said carpet surface having at least one of different shapes, different dimensions and different relative adjacent spacings relative to said interlocking elements on said floor surface.

2. A floor carpet installation system according to claim 1 wherein said thicknesses of said interlocking elements comprise mushroom-shaped heads.

3. A floor carpet installation system according to claim 1 wherein said thicknesses of said interlocking elements comprise plate-shaped heads.

4. A floor carpet installation system according to claim 2 wherein said heads have concave depressions on tops thereof.

5. A floor carpet installation system according to claim 3 wherein said heads have concave depressions on tops thereof.

6. A floor carpet installation system according to claim 4 wherein said depressions in said heads on said interlocking elements on at least one of said surfaces receives adhesive to provide an additional connection with one of said carpet loopless material and said floor loopless material.

7. A floor carpet installation system according to claim 5 wherein said depressions in said heads on said interlocking elements on at least one of said surfaces receives adhesive to provide an additional connection with one of said carpet loopless material and said floor loopless material.

8. A floor carpet installation system according to claim 6 wherein said adhesive comprises an acrylate base.

9. A floor carpet installation system according to claim 7 wherein said adhesive comprises an acrylate base.

10. A floor carpet installation system according to claim 1 wherein said loopless materials comprise felt.

11. A floor carpet installation system according to claim 1 wherein said loopless materials comprise fleece.

12. A floor carpet installation system according to claim 1 wherein said loopless materials comprise a loose leno weave.

13. A floor carpet installation system according to claim 1 wherein said loopless materials comprise a flat knit.

14. A floor carpet installation system according to claim 1 wherein said loopless materials comprise non-woven textile.

15. A floor carpet installation system according to claim 14 wherein said non-woven textile is synthetic material.

16. A floor carpet installation system according to claim 14 wherein said non-woven textile is needle punched felt.

17. A floor carpet installation system according to claim 1 wherein said floor loopless material comprises footstep-sound-absorbing properties.

* * * * *